US005964287A

United States Patent [19]

Brooks

[11] Patent Number: 5,964,287

[45] Date of Patent: Oct. 12, 1999

[54] WINDOW ASSEMBLY FOR MULTIPLE WELLBORE COMPLETIONS

[75] Inventor: Robert T. Brooks, Grand Prairie, Tex.

[73] Assignee: Dresser Industries, Inc., Dallas, Tex.

[21] Appl. No.: 09/054,367

[22] Filed: Apr. 2, 1998

Related U.S. Application Data

[60] Provisional application No. 60/042,927, Apr. 4, 1997.

[51] Int. Cl.[6] ..... E21B 7/08; E21B 23/00; E21B 43/14; E21B 43/30

[52] U.S. Cl. ..... 166/117.6; 166/50; 166/242.1; 175/79; 175/80

[58] Field of Search ..... 166/50, 117.6, 166/242.1, 242.5; 175/79, 80

[56] References Cited

U.S. PATENT DOCUMENTS

| | | | |
|---|---|---|---|
| 2,397,070 | 3/1946 | Zubling . | |
| 2,797,893 | 7/1957 | McCune et al. . | |
| 2,804,925 | 9/1957 | Zublin | 166/50 |
| 2,858,107 | 10/1958 | Colmerauer . | |
| 4,420,049 | 12/1983 | Holbert | 175/45 |
| 4,928,767 | 5/1990 | Jelsma | 166/117.6 |
| 5,222,554 | 6/1993 | Blount et al. | 166/117.6 |
| 5,311,936 | 5/1994 | McNair et al. | 166/50 |
| 5,318,121 | 6/1994 | Brockman et al. | 166/313 |
| 5,325,924 | 7/1994 | Bangert et al. | 166/313 |
| 5,388,648 | 2/1995 | Jordan, Jr. | 166/380 |
| 5,425,419 | 6/1995 | Sieber | 166/206 |
| 5,427,177 | 6/1995 | Jordan, Jr. et al. | 166/50 |
| 5,427,179 | 6/1995 | Bailey et al. | 166/117.6 |
| 5,431,219 | 7/1995 | Leising et al. | 166/50 |
| 5,467,819 | 11/1995 | Braddick | 166/117.6 |
| 5,474,131 | 12/1995 | Jordan, Jr. et al. | 166/313 |
| 5,477,925 | 12/1995 | Trahan et al. | 166/382 |
| 5,484,017 | 1/1996 | Coon | 166/117.5 |
| 5,520,252 | 5/1996 | McNair | 166/313 |
| 5,533,573 | 7/1996 | Jordan, Jr. et al. | 166/313 |
| 5,535,822 | 7/1996 | Schock et al. | 166/50 |
| 5,564,503 | 10/1996 | Longbottom et al. | 166/313 |
| 5,649,595 | 7/1997 | Davis et al. | 166/297 |
| 5,651,415 | 7/1997 | Scales | 166/250 |
| 5,678,634 | 10/1997 | Rehbock et al. | 166/377 |
| 5,697,445 | 12/1997 | Graham | 166/313 |
| 5,715,891 | 2/1998 | Graham | 166/313 |
| 5,730,224 | 3/1998 | Williamson et al. | 166/386 |
| 5,787,987 | 8/1998 | Forsyth et al. | 166/117.6 X |
| 5,806,614 | 9/1998 | Nelson | 175/61 |
| 5,875,847 | 3/1999 | Forsyth | 166/313 |

FOREIGN PATENT DOCUMENTS 0 701 040 A2 3/1996 European Pat. Off. .

OTHER PUBLICATIONS

PCT International Search Report for Int'l Application No. PCT/US98/06658 filed on Apr. 3, 1998, Sep. 7, 1998.

PCT International Search Report for Int'l Application No. PCT/US98/06653 filed on Apr. 3, 1998, Sep. 7, 1998.

Schlumberger Horizontal Well—Complete Analysis: Production Logging, DEFT Specifications, Mar. 10, 1997, 2 pages.

*Primary Examiner*—George Suchfield

*Attorney, Agent, or Firm*—Baker and Botts; Marlin R. Smith

[57] ABSTRACT

A window assembly is provided for use at a downhole location in a first wellbore to control access to or allow isolation of a second wellbore extending from the first wellbore. The window assembly is included as an integral part of a production tubing string disposed within the first wellbore. A slot is formed in the window assembly. The window assembly is preferably installed at a downhole location aligned to an opening from the first wellbore into the second wellbore whereby well tools may move between the longitudinal bore of the window assembly and the second wellbore. Multiple guide surfaces are provided in the slot to direct movement of tools between the longitudinal bore and the window assembly and the second wellbore or vice versa. One of the guide surfaces on the slot preferably is formed with approximately the same angle at which the second wellbore intersects the first wellbore.

20 Claims, 3 Drawing Sheets

FIG. 7
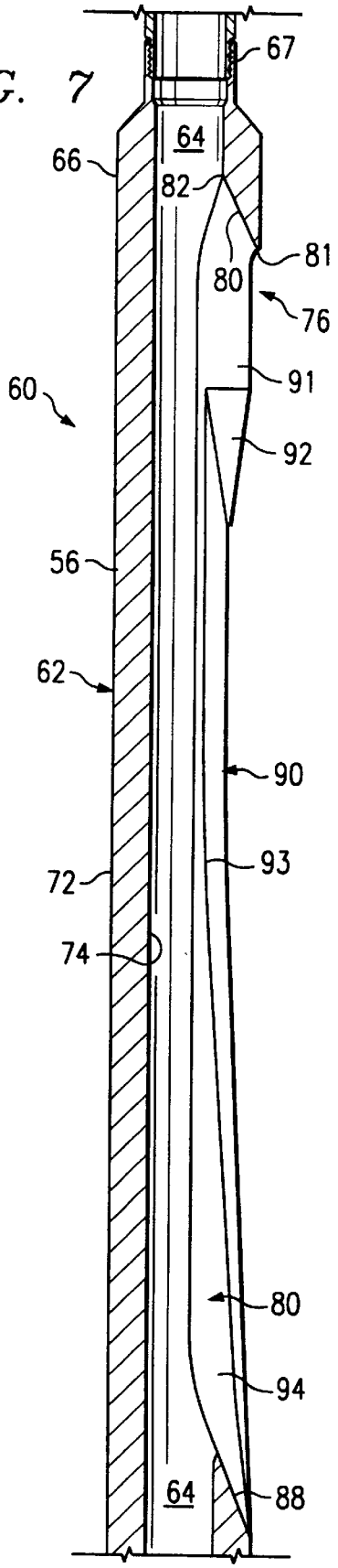
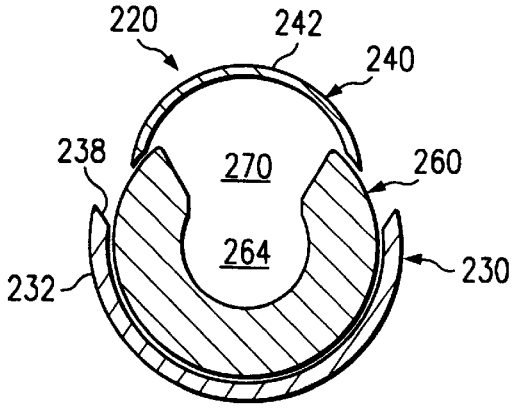
FIG. 8A
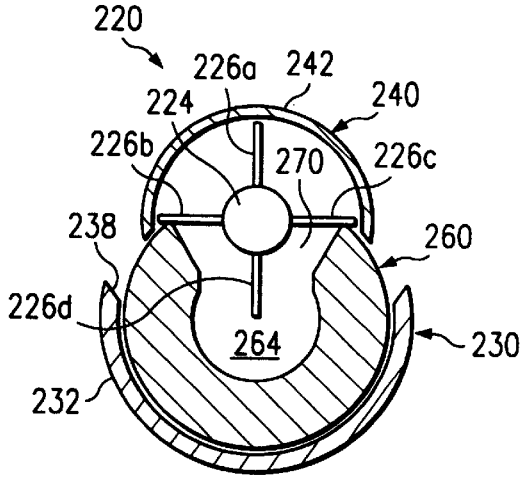
FIG. 8B
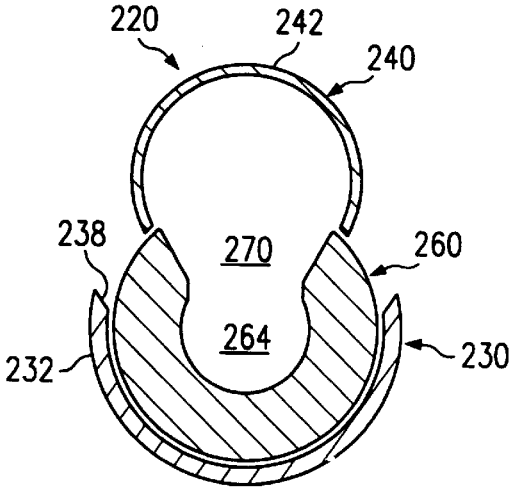
FIG. 8C

WINDOW ASSEMBLY FOR MULTIPLE WELLBORE COMPLETIONS

RELATED APPLICATIONS

This application claims the benefit of U.S. Provisional Application Ser. No. 60/042,927 filed Apr. 4, 1997.

This application is related to patent application Ser. No. 60/042,170 filed Mar. 31, 1997, and entitled Lateral Re-Entry System, now abandoned; patent application Ser. No. 09/054,365 filed Apr. 2, 1998 and entitled Method and Apparatus for Deploying a Well Tool into a Lateral Wellbore which claims priority from U.S. Ser. No. 60/042,927, filed Apr. 4, 1997; and patent application Ser. No. 09/054,366 filed Apr. 2, 1998 entitled Multilateral Whipstock and Tools for Installing and Retrieving which claims priority from U.S. Ser. No. 60/043,902 filed Apr. 4, 1997.

TECHNICAL FIELD OF THE INVENTION

The present invention relates generally to downhole equipment for a well completion having multiple wellbores and, more particularly, to apparatus which may be installed at a downhole location in a first wellbore to provide access to or allow isolation of a second wellbore extending from the first wellbore.

BACKGROUND OF THE INVENTION

During the past several years, substantial improvements have been made in three dimensional (3D) seismic surveys to better locate and define the boundaries of underground hydrocarbon producing formations. During this same time period, substantial improvements have also been made in directional drilling and horizontal well completion techniques. As a result, many current well completions often include more than one wellbore or borehole. For example, a first, generally vertical wellbore may be drilled within or adjacent to one or more hydrocarbon producing formations. Multiple wellbores may then be drilled extending from the vertical wellbore at selected locations designed to optimize production from the hydrocarbon producing formation or formations. Such well completions are often referred to as multilateral wells.

A typical multilateral well completion will include a generally vertical or primary wellbore defined in part by a casing string and a layer of cement disposed between the exterior of the casing string and the inside diameter of the primary wellbore. Directional drilling equipment and techniques may be used to form an exit or window in the casing string and layer of cement at a downhole location selected for drilling a lateral or secondary wellbore extending from the primary wellbore. The location and orientation of the casing window, the length and diameter of the secondary or lateral wellbore, and the orientation of the secondary wellbore relative to the primary wellbore and the hydrocarbon producing formation are selected based on characteristics of the associated hydrocarbon producing formation. For many locations such as deep offshore wells, multiple secondary or lateral wellbores will be drilled from each vertical wellbore in an effort to optimize hydrocarbon production while minimizing drilling and well completion costs. Selective isolation and/or re-entry into each of the secondary or lateral wellbores is often necessary to further optimize production from the associated hydrocarbon producing formation or formations.

A typical multilateral well completion may have one or more production tubing strings disposed within the casings string of the primary wellbore. The production tubing string or strings will have a generally uniform inside diameter extending from the well surface to a selected downhole location. A window assembly, sometimes referred to as a lateral re-entry window, will often be installed within each production tubing string at a downhole location corresponding with the location at which each secondary or lateral wellbore intersects the primary wellbore. For example, a multilateral well completion may have a first or primary wellbore with three or more secondary or lateral wellbores intersecting the primary wellbore at respective first, second and third, or more, downhole locations. The angle at which each of the secondary wellbores intersects the primary wellbore may vary at each downhole location. A production tubing string with three window assemblies may be installed within the casing string of the primary wellbore using conventional well completion techniques such that each window assembly is disposed and aligned adjacent to a respective lateral or secondary wellbore.

Existing window assemblies used in current multilateral well completions typically have a generally cylindrical configuration with a longitudinal bore extending therethrough. An elongated slot is generally milled through the exterior of the housing to allow movement of well tools between the longitudinal bore and the adjacent secondary or lateral wellbore. The housing of the window assembly generally has a relatively thick wall to compensate for the loss in material strength which results from forming the elongated slot. Often the casing exit window formed between the primary wellbore and the intersection of the secondary wellbore will have a generally teardrop configuration. The window assembly presents a generally thick walled, elongated rectangular opening through which well tools must move. The width of the rectangular opening is generally less than the nominal diameter of the lower primary tubing in the primary wellbore. As a result, well tools moving from the secondary wellbore into the primary wellbore will see two substantially different configurations at the window assembly. This change in configuration often results in well tools, particularly those well tools which have spring type centralizers, becoming engaged with or trapped by the elongated slot during re-entry from the secondary wellbore into the primary wellbore.

SUMMARY OF THE INVENTION

In accordance with teachings of the present invention, a window assembly is provided to substantially reduce or eliminate problems previously associated with inserting and removing well tools from lateral wellbores. One embodiment of the present invention includes a window assembly having a generally cylindrical housing with an elongated slot formed in the exterior of the housing to allow communication of well tools between a primary wellbore and a secondary wellbore. The elongated slot preferably includes a plurality of tapered and/or chamfered surfaces selected to minimize restrictions in moving well tools between the primary wellbore and an adjacent secondary wellbore and vice versa.

Technical benefits of the present invention include providing a window assembly having an elongated slot which will allow movement of a coil tubing and/or wireline conveyed tool string from a first wellbore into a second wellbore and allow safe recovery of the tool string back into the first wellbore. A pair of tapered surfaces are formed on opposite sides of the slot to provide a re-entry path corresponding approximately with the orientation of the second wellbore relative to the first wellbore. The tapered surfaces and other surfaces formed as part of the slot cooperate with each other to minimize any interference between the tool string and the elongated slot formed in the window assembly. A second set of surfaces formed on the elongated slot will preferably encourage centralizers such as springs to collapse uniformly in the slot as the tool string moves from the second wellbore into the first wellbore. The surfaces are formed as an integral part of the slot to provide a smooth transition between the second wellbore and the first wellbore.

For some applications, a landing nipple profile and sealbore may be provided above and below the elongated slot to allow an isolation sleeve to be installed therein. The isolation sleeve may be used to prevent undesired fluid flow and/or movement of well tools between the first wellbore and the second wellbore. For well completions having a first, generally vertical wellbore and multiple lateral wellbores extending therefrom, an isolation sleeve may be installed in each window assembly located at lateral wellbores above the selected lateral wellbore in which work will be performed. The isolation sleeves accommodate movement of logging tools, stimulation tools and/or well servicing tools through the first or primary wellbore to the selected lateral wellbore which will be serviced or logged.

BRIEF DESCRIPTION OF THE DRAWINGS

For a more complete understanding of the present invention and its advantages, reference is now made to the following brief description, taken in conjunction with the accompanying drawings and detailed description, wherein like reference numerals represent like parts, in which:

FIG. 7 is a schematic drawing in section with portions broken away showing the window assembly of FIG. 2 incorporating teachings of the present invention;

FIG. 8A is a schematic drawing in section with portions broken away showing portions of a previously available window assembly disposed at a first elevation within a casing string of a first wellbore adjacent to a liner for a second wellbore;

FIG. 8B is a schematic drawing in section with portions broken away showing another view of the window assembly, casing string and liner of FIG. 8A at a second elevation with a well tool having a centralizer disposed between the first wellbore and the second wellbore; and FIG. 8C is a schematic drawing in section with portions broken away showing a further view of the window assembly, casing string and liner of FIG. 8A at a third elevation.

DETAILED DESCRIPTION OF THE INVENTION

The preferred embodiments of the present invention and its advantages are best understood by referring now in more detail to FIGS. 1–8C of the drawings, in which like numerals refer to like parts.

Figure 1:
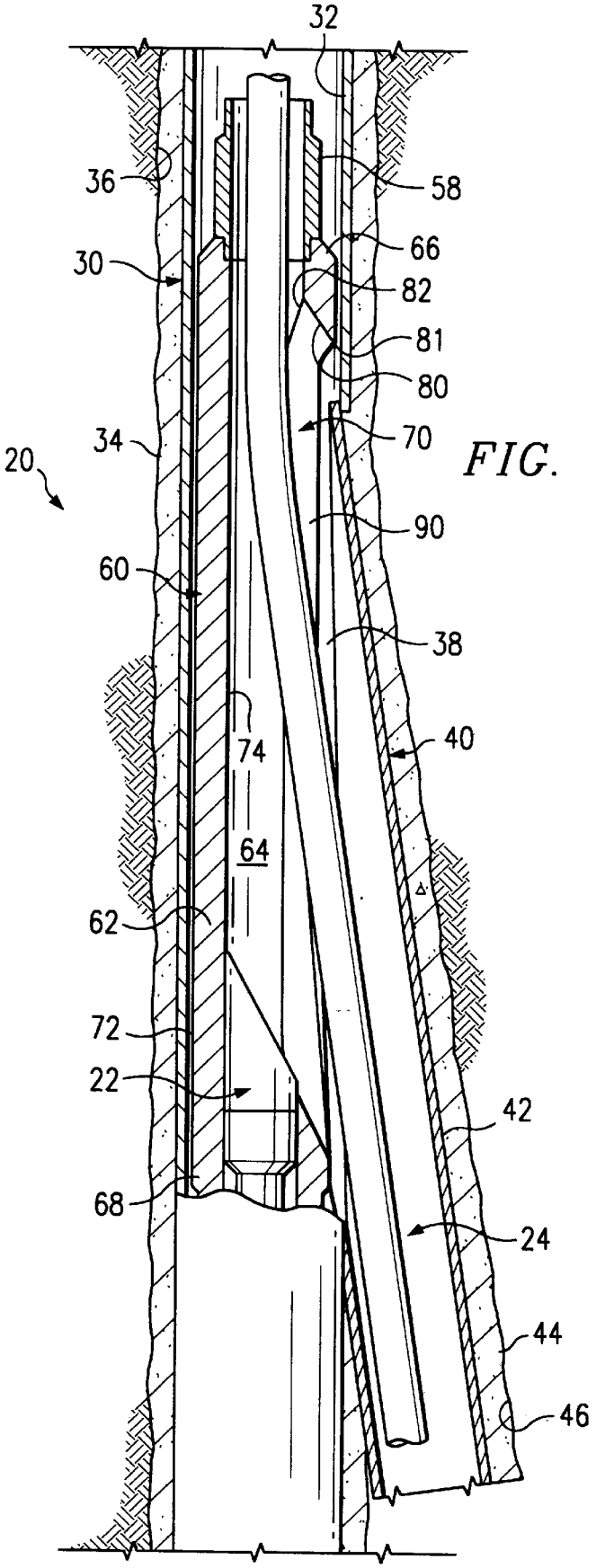
FIG. 1 is a schematic drawing in section and in elevation showing a well completion having a first wellbore with a second wellbore extending therefrom with a window assembly incorporating teachings of the present invention disposed within the first wellbore to minimize any restrictions in movement of a well tool between the first wellbore and the second wellbore.

FIG. 1 is a schematic drawing showing a portion of well 20 which includes first wellbore 30 and second wellbore 40. For the embodiment shown in FIG. 1 first wellbore 30 has a generally vertical configuration. Second wellbore 40 intersects first wellbore 30 at a relatively shallow angle of approximately four or five degrees as measured relative to the longitudinal axis of first wellbore 30. Current directional drilling and horizontal well completion techniques allow forming second wellbore 40 with a selected angle and radius relative to first wellbore 30 to optimize production from the adjacent hydrocarbon producing formation or formations (not expressly shown) while also minimizing the costs of drilling and completing first wellbore 30 and second wellbore 40. For some applications, well 20 may include multiple wellbores extending radially from first wellbore 30. If well 20 includes more than one secondary wellbore 40, well 20 may also be referred to as a "multilateral well completion."

First wellbore 30 includes casing string 32 with a layer of cement 34 disposed between the exterior of casing string 32 and inside diameter or wall 36 of wellbore 30. Conventional horizontal well drilling techniques may be used to form window 38 in casing 32. Second wellbore 40 includes liner 42 and a layer of cement 44 disposed between the exterior of liner 42 and the inside diameter or wall 46 of second wellbore 40. For some applications, second wellbore 40 may include a slotted liner without a layer of cement 44. For other applications, second wellbore 40 may be an "open hole completion" without a liner or cement disposed therein. Various types of well completion techniques and equipment may be satisfactorily used to form first wellbore 30 and second wellbore 40 depending upon the characteristics associated with the adjacent hydrocarbon producing formation.

Typically, one or more tubing strings (not expressly shown) will be installed within casing string 30 extending from the well surface (not expressly shown) to a desired downhole location. Various types of well completion equipment such as surface controlled subsurface safety valves, landing nipples, and production packers may be included within each tubing string. One or more window assemblies 60 incorporating teachings of the present invention are preferably included as a component part of a tubing string and respectively disposed adjacent to each window 38 in casing 32. For some applications, landing nipple 58 may be provided at opposite ends of window assembly 60 for use in releasably installing an isolation sleeve (not expressly shown) within window assembly 60.

Window assembly 60 preferably includes housing 62 with longitudinal bore 64 extending therethrough. Housing 62 includes first end 66 and second end 68. Various types of mechanical connections such as threaded connection 67 as shown in FIG. 7 may be formed on first end 66 and second end 68 to secure window assembly 60 within first wellbore 30 at a downhole location adjacent to the intersection with second wellbore 40. Various types of equipment such as a Sperry Sun RMLS Latch Assembly may be attached to second end 68 of window assembly 60 and a Dresser Oil Tools Torque Locked Packer assembly attached at first end 66 to assist in positioning window assembly 60 at the selected downhole location and with the desired orientation relative to second wellbore 40.

Window assembly 60 has a generally cylindrical configuration which includes exterior surface 72 and interior surface 74. The outside diameter of housing 62 is selected to be compatible with the inside diameter of casing string 32. Elongated slot 70 is preferably formed in and extends through exterior surface 72 and interior surface 74 of housing 60 to allow communication of well tools between longitudinal bore 64 and the exterior of window assembly 60. Conventional directional drilling and well completion techniques may be used to position window assembly 60 with elongated slot 70 disposed adjacent to and aligned with window 38 in casing 32 and second wellbore 40.

For some well servicing applications, a tubing exit whipstock or deflector 22 may be disposed within longitudinal bore 64 adjacent to second end 68 to direct various types of well tools or tool strings from longitudinal bore 64 through elongated slot 70 and casing window 38 into second wellbore 40. Whipstock or deflector 22 may also be referred to as a "tubing exit whipstock." Whipstocks satisfactory for use with the present invention are available from Dresser Oil Tools. Also, conventional well servicing techniques may be used to install and remove whipstock 22 and align deflector 22 with elongated slot 70. Copending U.S. patent application Ser. No. 09/054,366 filed Apr 2, 1998 entitled Multilateral Whipstock and Tools for Installing and Retrieving provides additional information concerning downhole equipment satisfactory for use with the present invention.

Tool string 24 is shown in FIG. 1 extending through first wellbore 30, longitudinal bore 64 of window assembly 60, elongated slot 70, casing window 38 into second wellbore 40. Tool string 24 may be conveyed on a coiled tubing (not expressly shown) or a wireline (not expressly shown) as appropriate. Coiled tubing is often used for servicing secondary wellbores which extend from a primary wellbore. Tool string 24 may include well logging equipment, perforating equipment, or other types of downhole well servicing tools which are commonly used in the oil and gas industry.

The length and width of elongated slot 70 is selected to allow well tools to move out of and into longitudinal bore 64 through elongated slot 70. Elongated slot 70 is defined in part by first end 76 and second end 78 with a pair of sides 90 and 110 extending generally parallel with each other between first end 76 and second end 78. Sides 90 and 110 also extend generally parallel with longitudinal bore 64. Multiple surfaces are formed as an integral part of each side 90 and 110 in accordance with teachings of the present invention to minimize or prevent any restrictions during movement of well tools and/or a tool string between first wellbore 30 and second wellbore 40.

Figures 2, 3, 4, 5, 6:
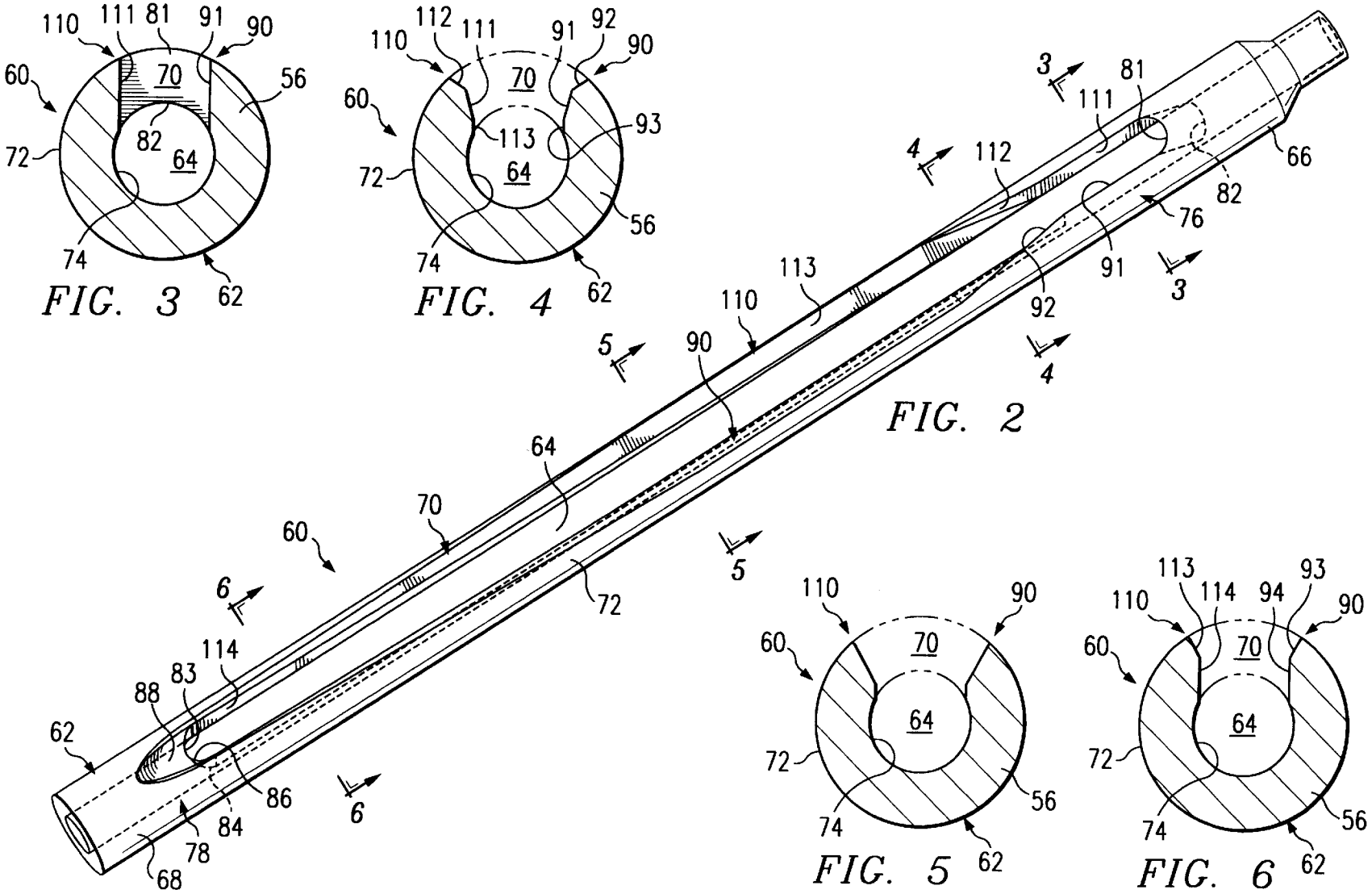
FIG. 2 is a schematic drawing showing an isometric view with portions broken away of a window assembly incorporating teachings of the present invention.
FIG. 3 is a schematic drawing in section taken along line 3—3 of FIG. 2.
FIG. 4 is a schematic drawing in section with portions broken away taken along line 4—4 of FIG. 2.
FIG. 5 is a schematic drawing in section with portions broken away taken along lines 5—5 of FIG. 2.
FIG. 6 is a schematic drawing in section with portions broken away taken along lines 6—6 of FIG. 2.

First end 76 of elongated slot 70 is defined in part by first radius 81 formed in exterior surface 72, and second radius 82 formed in interior surface 74 of housing 60. As shown in FIGS. 1, 2 and 7, first radius 81 is preferably offset longitudinally from second radius 82 to form well tool re-entry surface 80 therebetween. Well tool re-entry surface 80 preferably extends at a second angle relative to longitudinal bore 64. For some applications, second angle 80 will be larger than the first angle at which second wellbore 40 intersects first wellbore 30. The value of second angle 80 is preferably selected to provide a smooth transition for well tools moving from second wellbore 40 into longitudinal bore 64. The value selected for the second angle 80 associated with re-entry surface 80 will depend upon various dimensions associated with housing 60 such as the length and the nominal diameter of longitudinal bore.

Each side 90 and 110 of elongated slot 70 also includes respective first surface 91 and 111 formed respectively thereon immediately adjacent to first end 76. First surfaces 91 and 111 extend generally parallel with each other and with longitudinal bore 64.

Each side 90 and 110 of elongated slot 70 also includes respective second surfaces 92 and 112 which are formed immediately adjacent to respective first surfaces 91 and 111. Second surfaces 92 and 112 preferably extend at a third angle relative to respective first surfaces 91 and 111, and also at the same third angle relative to longitudinal bore 64. Sides 90 and 110 of elongated slot 70 also include a respective third surface or tapered surface 93 and 113 disposed immediately adjacent to respective second surfaces 92 and 112. Third surfaces 93 and 113 may also be referred to as tapered guide surfaces which extend toward second end 78 of elongated slot 70 at a third angle corresponding approximately with the first angle at which second wellbore 60 intersects first wellbore 30.

As discussed later in more detail, third surfaces 93 and 113 cooperate with each other to provide a relatively smooth path for re-entry of well tools from second wellbore 40 into longitudinal bore 64. The second angle at which second surfaces 92 and 112 intersect respective first surfaces 91 and 111 is selected to provide a relatively smooth transition for well tools moving from third surfaces 93 and 113 into the portion of elongated slot 70 defined by first surfaces 91 and 111.

Sides 90 and 110 of elongated slot 70 preferably include a respective fourth surface 94 and 114 which extends from second end 78 of elongated slot 70 toward first end 76. Fourth surfaces 94 and 114 preferably extend generally parallel with each other and parallel with longitudinal bore 64. As best shown FIGS. 2 and 7, the width or thickness of fourth surfaces 94 and 114, have a generally tapered configuration extending from second end 78 toward the intersection between the respective second surfaces 92 and 112 and third surfaces 93 and 113 along respective sides 90 and 110.

Second end 78 of elongated slot 70 is defined in part by third radius 83 formed in exterior surface 72 of housing 62, and fourth radius 84 formed in interior surface 74 of housing 62. Third radius 83 and fourth radius 84 are preferably aligned with each other to form well tool exit surface 86 extending therebetween. For some applications, first radius 81, second radius 82, third radius 83 and fourth radius 84 will have approximately the same radius. This same radius may be selected to be equal to or slightly less than the radius associated with longitudinal bore 64.

For some applications, generally conically shaped surface 88 may be formed in exterior surface 72 of housing 60 extending from third surfaces 93 and 113 respectively. Conical surface 86 is preferably formed at approximately the same angle corresponding with the first angle of intersection between second wellbore 40 and first wellbore 30. Conically shaped surface 88 cooperates with third surfaces 93 and 113 extending along respective sides 90 and 110 of elongated slot 70 to provide a smooth path for re-entry of well tools from second wellbore 40 into longitudinal bore 64 of housing 62.

As best shown in FIGS. 3–6, the portion of longitudinal bore 64 adjacent to elongated slot 70 preferably has a generally uniform inside diameter as represented by inside surface 74. The width of elongated slot 70 is preferably selected to be equal to or slightly less than the corresponding inside diameter of longitudinal bore 64.

Depending upon various factors such as the length and diameter of the associated tubing string, and the configuration of first wellbore 30, window assembly 60 may be subjected to substantial tension, compression and/or rotational stresses during installation of the tubing string within first longitudinal wellbore 30. Also, production fluid flow through the associated wellbore and/or changes in fluid flow through the associated production tubing may apply additional forces thereto. As a result, wall 56 which forms a substantial portion of housing 62, has a relatively large thickness as compared with the nominal thickness associated with the tubing string used to install window assembly 60 at the desired downhole location.

Window assembly 60 incorporating teachings of the present invention has been described with respect to elongated slot 70 having first end 76, second end 78 and multiple guide surfaces 91–94 and 110–114 formed as integral portions thereof. For some applications, a window assembly incorporating teachings of the present invention may only include first end 76, first surfaces 111 and 91, along with second surfaces 112 and 92. The remaining portions of such window assembly may have surfaces which correspond generally with the surfaces associated with prior window assemblies.

For other applications, a window assembly incorporating teachings of the present invention may include an elongated slot with only third surfaces 93 and 113 formed adjacent to the slot. The present invention allows fabrication of a window assembly with multiple guide surfaces which are selected to minimize restrictions in moving of well tools between the associated primary wellbore and secondary wellbore.

FIGS. 8A–C are schematic drawings in section showing a portion of well 220 which includes first wellbore 230 and second wellbore 240. Well 220, first wellbore 230 and second wellbore 240 may have substantially the same configuration as previously described with respect to well 20, first wellbore 30 and second wellbore 40. First wellbore 230 includes casing string 232 and casing window 238. Second wellbore 240 includes liner 242 disposed adjacent to casing window 238. One or more layers of cement (not expressly shown) will preferably be disposed between the exterior of casing string 230, liner 242 and adjacent portions of casing window 238 to maintain desired fluid integrity between first wellbore 230, second wellbore 240 and the adjacent downhole formation.

Portions of window assembly 260, which is an example of a previously available window assembly used prior to the present invention, are shown disposed within casing string 220 in FIGS. 8A–C. Window assembly 260 includes longitudinal bore 264 extending therethrough. Elongated slot 270 is preferably formed in window assembly 260 to allow communication of well tools between longitudinal bore 264 and second wellbore 240. The configuration of elongated slot 270 as shown in FIGS. 8A–C is representative of window assemblies which have previously been used in multilateral well completions to communicate well tools between a first wellbore and a second wellbore.

FIG. 8B shows well tool 224 with centralizers 226 extending therefrom. Many production logging tools often have a relatively small diameter as compared with the inside diameter of the wellbore or tubing string in which downhole characteristics of the hydrocarbon producing formation will be measured. As a result, centralizers such as bow strings are frequently attached to such logging tools to maintain their desired orientation within the respective wellbore or production tubing string. The use of centralizers on production logging tools and other service tools is particularly important when servicing horizontal or lateral wellbores since gravitational forces would normally cause the tool string to ride along the lower surface of the wellbore or production tubing string.

FIG. 8A is a representative cross section between first wellbore 230 and second wellbore 240 near the upper end or first end of window assembly 260. FIG. 8B shows a representative cross section of first wellbore 230 and second wellbore 240 at an intermediate location relative to the first end and the second end of window assembly 260. FIG. 8C shows a representative cross section of first wellbore 230 and second wellbore 240 near the second end of window assembly 260. Such previously available window assemblies included a slot with a generally uniform cross section as represented by FIGS. 8A–8C.

As best shown in FIG. 8B, elongated slot 270 provides a pair of edges on which may engage centralizer arms 226. As well tool 224 moves from the position shown in FIG. 8B toward the position shown in FIG. 8A, centralizer arm 226*a* will tend to be compressed. However, centralizer arm 226*b* and 226*c* may become trapped or wedged between the inside diameter of liner 224 and the exterior portions of window assembly 226 immediately adjacent to slot 270. Also, centralizer portion 226*d* will remain spaced from longitudinal bore 260 and will not retract. Therefore, movement of well tool 224 from secondary wellbore 240 into first wellbore 230 may be substantially restricted.

Typically, a bow spring type centralizer requires application of force to respective opposed pairs of centralizer arms 226*a* and 226*c* at approximately the same time or location in a wellbore to prevent one or more of the centralizer arms 226*a*, 226*b*, 226*c* and 226*d* becoming trapped by a restriction or ledge in the wellbore.

When a bow spring type centralizer such as shown in FIG. 8B moves from second wellbore 40 into first wellbore 30, an opposing pair of centralizer arms 226*b* and 226*c* will preferably move along third surfaces 93 and 113 until centralizer arms 226*b* and 226*c* contact respective second surfaces 92 and 112. Second surfaces 92 and 112 cooperate with each other to apply approximately the same amount of force to cause generally uniform retraction of centralizer arms 226*a, b, c* and *d*. Depending upon the orientation of the well tool 224 within elongated slot 70, either centralizer arm 226*a* or 226*d* will engage re-entry surface 80 to allow compressing or retracting the respective centralizer arm 226*a* or 226*d* to allow well tool 224 to continue moving into longitudinal bore 64.

Although the present invention has been described by several embodiments, various changes and modifications may be suggested to one skilled in the art. It is intended that the present invention encompasses such changes and modifications as fall within the scope of the present appended claims.

What is claimed is:

1. A window assembly for communicating well tools between a first wellbore and a second wellbore which intersects the first wellbore at a first angle, the window assembly comprising:

a housing having a first end and a second end with a longitudinal bore extending therethrough;

mechanical connections formed at the first end and the second end of the housing to secure the window assembly within a tubing string at a downhole location in the first wellbore adjacent to the intersection with the second wellbore;

the housing having an exterior surface and an interior surface;

an elongated slot formed in and extending through the exterior surface and the interior surface of the housing for communicating the well tools between the longitudinal bore and the exterior of the window assembly;

the slot having a first end and a second end with a pair of sides extending generally parallel with each other between the first end and the second end and extending generally parallel with the longitudinal bore;

each side of the slot having multiple surfaces formed thereon; and each side of the slot having a tapered surface extending from a location spaced longitudinally from the first end of the slot toward the second end of the slot at an angle corresponding approximately with the first angle at which the second wellbore intersects the first wellbore whereby the tapered surfaces cooperate with each other to minimize restrictions in moving well tools from the second wellbore into the longitudinal bore of the housing.

2. The window assembly of claim 1 further comprising:

the first end of the slot defined in part by a first radius formed in the exterior surface of the housing and a second radius formed in the interior surface of the housing with the first radius longitudinally offset from the second radius to form a well tool re-entry surface extending at a second angle relative to the longitudinal bore of the housing;

each side of the slot having a first surface disposed immediately adjacent to the first end with the first surfaces of the slot extending generally parallel with each other and with the longitudinal bore;

each side of the slot having a second surface formed immediately adjacent to the respective first surface and extending at a third angle relative to the respective first surface and the longitudinal bore of the housing whereby the second surfaces cooperate with the respective first surfaces to direct well tools from the second wellbore into the longitudinal bore through the first end of the slot; and each side of the slot having a third surface disposed immediately adjacent to the respective second surface, the third surface corresponding with the tapered surface which extends toward the second end of the slot at the angle corresponding approximately with the first angle at which the second wellbore intersects the first wellbore.

3. The window assembly of claim 2 further comprising:

each side of the slot having a fourth surface which extends from the second end of the slot toward the first end of the slot;

the fourth surface of each side of the slot extending generally parallel with each other and with the longitudinal bore; and the fourth surface of each side of the slot having a generally tapered configuration extending from the second end toward the intersection between the second surface and the third surface along the respective side of the slot.

4. The window assembly of claim 2 further comprising the second end of the slot defined in part by a third radius formed in the exterior surface of the housing and a fourth radius formed in the interior surface of the housing with the third radius aligned generally with the fourth radius to form a well tool exit surface extending at a third angle relative to the longitudinal bore.

5. The window assembly of claim 4 further comprising the first radius, the second radius, the third radius and the fourth radius having approximately the same dimensions.

6. The window assembly of claim 1 further comprising:

the second end of the slot having a generally conically shaped surface formed in the exterior surface of the housing extending from the tapered surfaces at the same angle corresponding approximately with the first angle of intersection between the second wellbore and the first wellbore; and the conically shaped surface cooperating with the tapered surface on each side of the slot to provide a smooth path for re-entry of well tools from the second wellbore into the longitudinal bore of the housing.

7. The window assembly of claim 2 further comprising:

each side of the slot adjacent to the first end having a first surface extending from the longitudinal bore through the exterior of the housing and a second surface extending from the exterior of the housing toward the longitudinal bore;

the first surface and the second surface intersecting with each other;

the first surfaces extending from the first end of the slot substantially parallel with a longitudinal axis and normal to a radial axis of the longitudinal bore;

the second surfaces extending respectively through the housing at a fourth angle relative to the longitudinal bore and at a fifth angle relative to the radial axis; and the first end of the slot, the first surfaces and the second surfaces cooperating with each other to form an entrance for well tools to move from the second wellbore into the longitudinal bore of the housing.

8. The window assembly of claim 1 further comprising:

the portion of the longitudinal bore adjacent to the slot having a generally uniform inside diameter; and the width of the elongated slot selected to be less than the diameter of any well tools that may be inserted through the longitudinal bore to another location within the first wellbore.

9. The window assembly of claim 4 further comprising:

the longitudinal bore having a generally uniform inside diameter adjacent to the elongated slot; and the dimensions of the first radius, second radius, third radius and fourth radius corresponding approximately with the radius of the inside diameter of the longitudinal bore.

10. The window assembly of claim 1 wherein the housing further comprises:

a wall having a generally cylindrical configuration with the slot formed therein; and the wall having a nominal thickness which is larger than a nominal thickness for the associated tubing string whereby the housing can support tubing loads of tension, compression and rotation even though a substantial portion of the wall has been removed to form the slot.

11. A window assembly for communicating well tools between a first wellbore and a second wellbore which intersects the first wellbore at a first angle at a downhole location in a multilateral well completion, the window assembly comprising:

a housing having a first end and a second end with a longitudinal bore extending therethrough;

mechanical connections formed at the first end and the second end of the housing to secure the window assembly within a tubing string at the downhole location in the first wellbore adjacent to the second wellbore;

the housing having an exterior surface and an interior surface;

an elongated slot formed in and extending through the exterior surface and the interior surface of the housing; the slot having a length and a width selected to allow communication of well tools between the longitudinal bore and the second wellbore;

the slot having a first end and a second end with a pair of sides extending generally parallel with each other between the first end and the second end;

each side of the slot having multiple surfaces formed as an integral part thereof;

the first end of the slot defined in part by a first radius formed in the exterior surface of the housing and a second radius formed on the interior surface of the housing with the first radius longitudinally offset from the second radius to form a well tool re-entry surface extending at a second angle relative to the longitudinal bore of the housing;

each side of the slot having a first surface disposed immediately adjacent to the first end with the first surfaces of the slot extending generally parallel with each other and with the longitudinal bore;

each side of the slot having a second surface formed immediately adjacent to the respective first surface and extending at a third angle relative to the respective first surface and the longitudinal bore whereby the second surface cooperates with the first surface to direct well tools form the second wellbore into the longitudinal bore of the housing through the first end of the slot; and each side of the slot having a third surface disposed immediately adjacent to the respective second surface with the third surface extending toward the second end of the slot at a fourth angle corresponding approximately with the first angle at which the second wellbore intersects the first wellbore.

12. The window assembly of claim 11 further comprising:

each side of the slot having a fourth surface which extends from the second end of the slot toward the first end of the slot;

the fourth surface of each side of the slot extending generally parallel with each other and with the longitudinal bore;

the fourth surface of each side of the slot having a generally tapered configuration extending from the second end toward the intersection between the second surface and the third surface along the respective side of the slot; and the second end of the slot defined in part by a third radius formed in the exterior surface of the housing and fourth radius formed in the interior surface of the housing with the third radius and the fourth radius intersecting with each other to form a well tool exit surface.

13. The window assembly of claim 11 further comprising:

the second end of the slot having a generally conically shaped surface formed in the exterior surface of the housing extending from the third surface at the same angle corresponding generally with the first angle of intersection between the second wellbore and the first wellbore; and the conically shaped surface cooperating with the third surface on each side of the slot to provide a smooth path for re-entry for well tools from the second wellbore into the longitudinal bore of the housing.

14. The window assembly of claim 11 further comprising:

each side of the slot adjacent to the first end having a first surface extending from the longitudinal bore through the exterior of the housing and a second surface extending from the exterior of the housing toward the longitudinal bore;

the first surface and the second surface intersecting with each other;

the first surfaces extending from the first end of the slot substantially parallel with a longitudinal axis and normal to a radial axis of the longitudinal bore;

the second surfaces extending respectively through the housing at a fourth angle relative to the longitudinal bore and at a fifth angle relative to the radial axis; and the first end of the slots, the first surfaces and the second surfaces cooperating with each other to form an entrance for well tools to move from the second wellbore into the longitudinal bore of the housing.

15. A window assembly for communicating well tools between a first wellbore and a second wellbore which intersects the first wellbore at a first angle at a downhole location, the window assembly comprising:

a housing having a first end and a second end with a longitudinal bore extending therethrough;

mechanical connections formed at the first end and the second end of the housing to secure the window assembly within a tubing string at the downhole location in the first wellbore adjacent to the second wellbore;

the housing having an exterior surface and an interior surface with an elongated slot formed in and extending through the exterior surface and the interior surface of the housing;

the slot having a length and a width selected to allow communication of well tools between the longitudinal bore and the second wellbore;

the slot having a first end and a second end with a pair of sides extending generally parallel with each other between the first end and the second end;

each side of the slot having multiple surfaces formed as an integral part thereof;

the first end of the slot defined in part by a first radius formed in the exterior surface of the housing and a second radius formed on the interior surface of the housing with the first radius longitudinally offset from the second radius to form a well tool re-entry surface extending at a second angle relative to the longitudinal bore of the housing;

each side of the slot having a first surface disposed immediately adjacent to the first end with the first surfaces of the slot extending generally parallel with each other and with the longitudinal bore; and each side of the slot having a second surface formed immediately adjacent to the respective first surface and extending at a third angle relative to the respective first surface and the longitudinal bore whereby the second surface cooperates with the first surface to direct well tools from the second wellbore into the longitudinal bore of the housing through the first end of the slot.

16. The window assembly of claim 15 further comprising:

each side of the slot having a third surface disposed immediately adjacent to the respective second surface with the third surface extending toward the second end of the slot at a fourth angle corresponding approximately with the first angle at which the second wellbore intersects the first wellbore;

each side of the slot having a fourth surface which extends from the second end of the slot toward the first end of the slot; and the fourth surface of each side of the slot extending generally parallel with each other and with the longitudinal bore.

17. The window assembly of claim 16 further comprising:

the second end of the slot having a generally conically shaped surface formed in the exterior surface of the housing extending from the third surface at the same angle corresponding generally with the first angle of intersection between the second wellbore and the first wellbore; and the conically shaped surface cooperating with the third surface on each side of the slot to provide a smooth path for re-entry of well tools from the second wellbore into the longitudinal bore of the housing.

18. The window assembly of claim 15 further comprising the first end of the slot, the first surfaces and the second surfaces cooperating with each other to form an entrance for well tools to move from the second wellbore into the longitudinal bore of the housing.

19. The window assembly of claim 15 further comprising:

the portion of the longitudinal bore adjacent to the elongated slot having a generally uniform inside diameter; and the width of the elongated slot selected to be generally less than the diameter of any well tools that may be inserted through the window assembly to portions of the first wellbore therebelow.

20. The window assembly of claim 15 further comprising:

the longitudinal bore having a generally uniform inside diameter adjacent to the elongated slot; and the dimensions of the first radius and the second radius corresponding approximately with the radius of the inside diameter of the longitudinal bore.

* * * * *